US005365070A

United States Patent [19]

Anderson et al.

[11] Patent Number: 5,365,070

[45] Date of Patent: Nov. 15, 1994

[54] NEGATIVE ION BEAM INJECTION APPARATUS WITH MAGNETIC SHIELD AND ELECTRON REMOVAL MEANS

[75] Inventors: Oscar A. Anderson, Berkeley; Chun F. Chan, Hayward; Ka-Ngo Leung, Hercules, all of Calif.

[73] Assignee: The Regents of the University of California, Oakland, Calif.

[21] Appl. No.: 875,778

[22] Filed: Apr. 29, 1992

[51] Int. Cl.[5] ..... H01J 27/02

[52] U.S. Cl. ..... 250/423 R; 250/424; 313/360.1

[58] Field of Search ..... 250/423 R, 424, 427; 313/360.1, 361.1, 363.1

[56] References Cited

U.S. PATENT DOCUMENTS

| | | | |
|---|---|---|---|
| 3,648,015 | 3/1972 | Fairbairn | 427/453 |
| 3,663,360 | 5/1972 | Post | 376/147 |
| 4,172,008 | 10/1979 | Fleet | 376/127 |
| 4,390,494 | 6/1983 | Salisbury | 376/107 |
| 4,486,665 | 12/1984 | Leung et al. | 250/427 |
| 4,739,214 | 4/1988 | Barr | 250/423 R |
| 4,931,640 | 6/1990 | Marshall et al. | 250/291 |
| 4,933,551 | 6/1990 | Bernuis et al. | 250/288 |
| 5,198,677 | 3/1993 | Leung et al. | 250/423 R |

*Primary Examiner*—Jack I. Berman
*Assistant Examiner*—James Beyer
*Attorney, Agent, or Firm*—Paul R. Martin; Kathleen S. Moss; Pepi Ross

[57] ABSTRACT

A negative ion source is constructed to produce $H^-$ ions without using Cesium. A high percentage of secondary electrons that typically accompany the extracted $H^-$ are trapped and eliminated from the beam by permanent magnets in the initial stage of acceleration. Penetration of the magnetic field from the permanent magnets into the ion source is minimized. This reduces the destructive effect the magnetic field could have on negative ion production and extraction from the source. A beam expansion section in the extractor results in a strongly converged final beam.

40 Claims, 8 Drawing Sheets

NEGATIVE ION BEAM INJECTION APPARATUS WITH MAGNETIC SHIELD AND ELECTRON REMOVAL MEANS

The United States Government has rights in this invention pursuant to Contract No. DE-AC03-76SF00098 between the US. Department of Energy and the University of California.

BACKGROUND OF THE INVENTION

1. Field of the Invention

This invention relates to a new, compact, and improved negative ion source and injector system, including preaccelerator and beam transport innovations. More particularly, it relates to methods and apparatus for efficiently excluding electrons from the negative ion beam and creating a high-angle convergent beam for injection into other devices including accelerator stages.

2. Description of the Background

Energetic neutral beams are difficult to create but are necessary for many applications. For example, charged particles cannot be injected through the large magnetic fields surrounding many high energy accelerators, for example the proton synchrotron, and other devices because the charged particles would be deflected from their path by the magnetic field. None-the-less, particles must be charged so that a voltage gradient can be used to extract them from the plasma. This means that particles used in high energy devices are likely to go through several stages prior to injection in the device. They are initially electrically charged so they can be extracted from the plasma gas that contains the negative ion. The charged particles are accelerated through many stages, then the beam has its charge changed just prior to injection into the high energy device.

It is desirable that as many electrons as possible are eliminated from the beam immediately upon exit from the ion source. The undesired high energy electrons, found in negative ion beams, are currently separated from a negative hydrogen ion beam by using an ExB electron extractor which diverts them to collector electrodes. Because of the magnetic field surrounding them, permanent magnets could not be placed near the exit aperture of the ion source without compromising the efficiency of the source. Placing the magnets downstream requires a considerable amount of power and is a substantial power drain on a system.

One approach for the production of negative ions and suppression of accompanying electrons is disclosed in US. Pat. No. 4,486,665. The approach described therein filters high-energy electrons by dividing the ion source chamber into two zones, an ionizing zone and an extraction zone. Excess electrons are suppressed by placing a plasma grid adjacent to the extraction zone of the ionization vessel that is positively-biased with respect to the anode. The positively biased grid suppresses electrons that would be dragged along with the positive ions which originate in the ionizing zone and pass through the magnetic filter. Additionally, electrons are suppressed from the output by providing a magnetic field, aligned with respect to the electric field of the extractor, to provide ExB drift to the electrons. There is some difficulty with that system, however. The magnets described in that patent are located interior to the ion source. Those magnets interfere with negative ion extraction, reducing the number of negative ions extracted by approximately a factor of 2. In addition, fewer electrons are successfully diverted from the negative ion beam than with the present invention. Further, when a radio frequency source is used to generate the negative ions, the magnet field resulting from the magnets as used in US. Pat. No. 4,486,665 interfere with the production of negative ions within the ion source volume. In order to create a magnetic field to deflect electrons from the extracted beam without interfering with ion production and extraction for the invention described in that patent, the magnets would have be located far enough down the beam transport line that the magnetic field would not penetrate the ion source vessel. This would lengthen the beam transport dimensions and interfere with the geometry of the electrodes used to focus the beam. If the magnetic field does enter the ion source vessel, negative ion production becomes less efficient. Lengthening the beam transport dimensions requires added power consumption and control circuitry.

It is important to keep the gas pressure low in the accelerator column. If gas pressure rises too high, collisions between negative ions and contaminants will cause electrons to be stripped from the ion prematurely.

There are several examples of devices that require energetic neutral beams created from negative ion particles. For example, large magnetic-confinement fusion energy devices such as tokamac accelerators, require 1 MeV neutral beams for injection. In order for the extracted beam to be injected into the cyclotron storage and acceleration ring without being defocused when crossing the electromagnetic fields, the beam charge must be changed and negative ions are more easily changed than positive ions. High energy cyclotron accelerators also require charge changed beams in order for the beam to be extracted from the cyclotron, booster ring. (L. W. Alvarez, Rev. Sci. Instr. 22(1951)705). Another application of the invention is for energetic particle beams that must be neutral in charge to transit large distances in space. The superconductor supercollider (SSC) is similarly in need of a high energy particle beam that could be created from a high quality negative ion source.

BRIEF SUMMARY OF THE INVENTION

An important advantage of the current invention is that the electron-deflecting magnets can be placed immediately adjacent to the exit aperture of the ion source vessel without interfering with the ion extraction efficiency of the source. Beam transport geometries are not compromised and highly convergent beams can be focused to the radio frequency quadrapole injector.

Immediately upon extraction from the source, the electrons are deflected with a permanent magnet located in the exit aperture. Alternatively the permanent magnet may be located in the first focusing electrode located along the beam line. The electrons are captured so that they will not reflect back into the downstream negative ion beam nor will they concentrate on the collector in a fashion that would cause the collector to become pitted or form holes. Carbon steel is used to prevent the magnetic field from extending significantly into the ion source vessel. This prevents the permanent magnets from decreasing the optimum production and extraction efficiency of the ion source. Use of carbon steel allows the permanent magnet to be located in immediate proximity to the exit orifice of the ion source chamber, resulting in highly effective deflection of electrons. Further downstream, an essentially electron-free beam is decelerated and allowed to expand so it can be strongly converged in final focused beam that enters the next stage of acceleration, frequently a Radio Frequency Quadrupole (RFQ). The invention can be used with any negative ion source.

The object of the invention is to provide a highly focused, energetic, negative-ion beam that is free of electrons. The further object of the invention is to deflect or divert electrons from the negative ion beam immediately after the electrons have exited the ion source volume through the exit aperture. An additional object of the invention is to shield or protect the exit aperture and the ion source from the magnetic field used to divert electrons from the negative ion beam. Yet another object of the invention is to collect the electrons so that they do not reenter the negative ion beam path. An even further object of the invention is to prevent secondary electrons from entering the beam path. Additionally, it is an object of the invention to configure the electrodes to be minimum in number while focusing the negative ion beam at the correct current, emittance, angle, and energy for the next acceleration stage.

BRIEF DESCRIPTION OF THE DRAWINGS

The accompanying drawings are briefly described as follows.

DETAILED DESCRIPTION OF THE INVENTION

Figure 1:
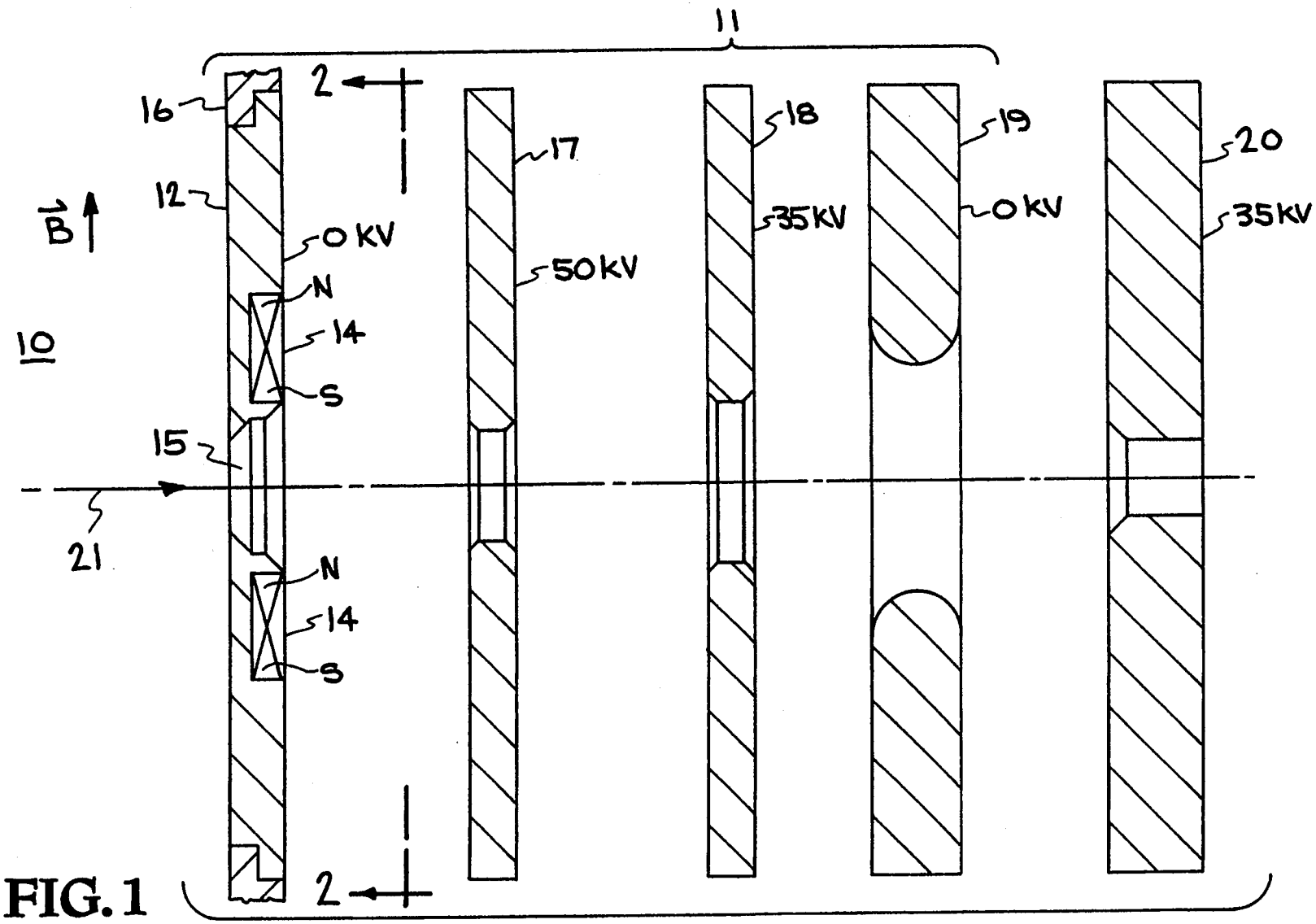
FIG. 1 is a schematic side view of the injector apparatus using a negative ion source.
Figure 1A:
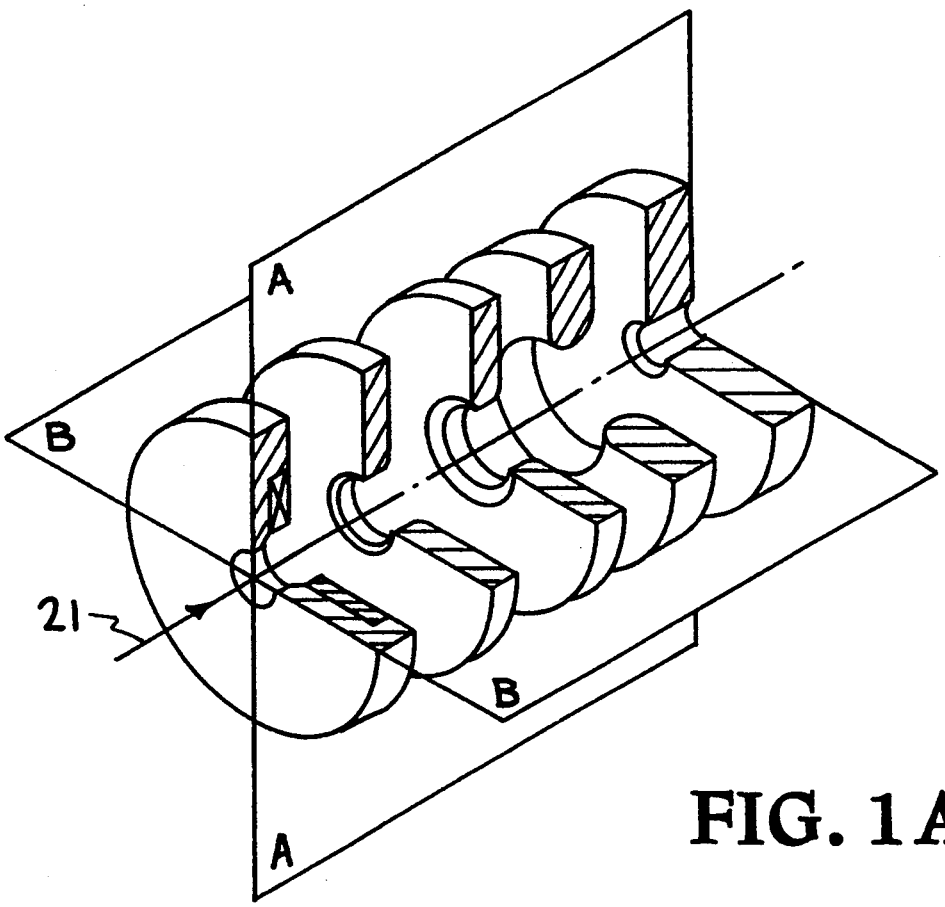
FIG. 1A is a 3-dimensional view of the electrodes shown in FIG. 1. Planes "A" and "B" define the planes shown in subsequent figures.

The ion beam injection system that is the subject of this invention includes all of the elements necessary for extracting ion particles from the source, deflecting electrons out of the beam path, accelerating the negative ion beam to 35 KeV, and delivering a focused beam to the next stage of acceleration such as a radio frequency quadrupole (RFQ), where the negative ion will be accelerated to higher energies. An RFQ, for example, would accelerate the beam to approximately 1 MeV.

Positive ions are neutralized by adding electrons; negative ions are neutralized by stripping electrons. Positive ion beams have had the advantage that electrons, unavoidably generated along with the positive ions, can be suppressed from appearing in the output flux because the negatively charged electrons are repelled by the negative potential on the extractor grids. The disadvantage of using positive ions is that an energetic positive ion beam is difficult to neutralize. As the positive ion beam energy increases, the ion cross-section for adding electrons decreases and the efficiency of neutralization through electron collision decreases concomitantly.

Negative ion sources are preferable over positive ion sources to generate high-energy neutral particle beams because at high energies the negative ion is easier to neutralize than the corresponding positive ion. Neutralizing, for example, negative hydrogen ions, requires stripping a weak 0.7 ev bond between an electron and the neutral atom. Negative hydrogen ion beams with energies exceeding 150 KeV can be neutralized with greater than 60% efficiency Unfortunately, however, electrons cannot be easily removed from negative ion beams and present high-current sources of negative ions are accompanied by considerable numbers of undesired electrons. Power is wasted in accelerating unneeded electrons with the additional problems that the high energy electrons produce considerable amounts of undesired X-rays.

The invention provides a means for locating one or more magnets within close proximity of, or immediately adjacent to, the aperture of a negative ion source in a manner that prevents the magnetic field associated with the permanent magnets from entering the volume of the ion source where the magnetic field could interfere with ion extraction. The ion source used in some of our embodiments is described in a paper by K. N. Leung, et. al. Review of Scientific Instruments, vol 62, page 100, 1991, incorporated herein by reference. In addition, the electrode placement and applied electrical potentials prevent secondary electrons from entering the particle beam downstream. The electrode placement also provides a means to construct a highly-convergent electron-free beam in a short length of beam path. A simplified arrangement of electrodes and open structure allow a short beam transport length (that can be less than 10 cm), reduced number and complexity of power supplies, and fast pumping so that beam stripping is small and gas pressure at the entrance to the next acceleration stage is low.

The section that follows is divided into the following subsections:

Shielding ion source and exit aperture from magnetic field associated with electron-diverting magnets Removal of extracted electrons Electrode configuration and beam focusing in the beam transport system Shielding ion source and exit aperture from magnetic field associated with electron-diverting magnets This invention provides a method for locating magnets near the exit aperture of a negative ion source without interfering with the efficiency of ion extraction. This invention further provides a magnetic field shielding means. The magnets can be located immediately adjacent to the aperture or located in the region of the exit beam path. The magnets can be located so close to the exit aperture that they are mounted on the chassis in which the aperture is located. The purpose of mounting magnets near the exit aperture is to provide a magnetic field strong enough to preferentially deflect electrons from the negative ion beam after they are extracted from the source. Since it is also desirable to minimize the beam path length between the exit aperture and the point where the focused beam can enter the next stage of acceleration, it is preferable to locate the magnets as close to the exit aperture as possible.

To prevent the magnetic field associated with the magnets from entering the ion source where the field will interfere with the efficient production and extraction of ions, a metal with a high magnetic permeability, $\mu$, is placed in the region between the magnets and the ion source or in the area immediately surrounding the magnets or exit aperture of the ion source. One typical type of metal with high magnetic permeability is carbon steel. Preferably, the magnetic permeability of the carbon steel is in the range between about $10^2$ and $10^6$ gauss/oersted. Magnetic permeability values of carbon steel between about $10^3$ and $10^4$ gauss/oersted have performed very well. The range of magnetic permeability values of the carbon steel can range from about $10^3$ to about $10^5$ gauss/oersted, or even up to about $10^6$ gauss/oersted. More specifically, carbon steel designated by any SAE number from 1006 to 1095 provides adequate magnetic permeability to shield the plasma chamber from the magnetic field. Carbon steel with SAE number 1018 performed very well.

Figure 8A:
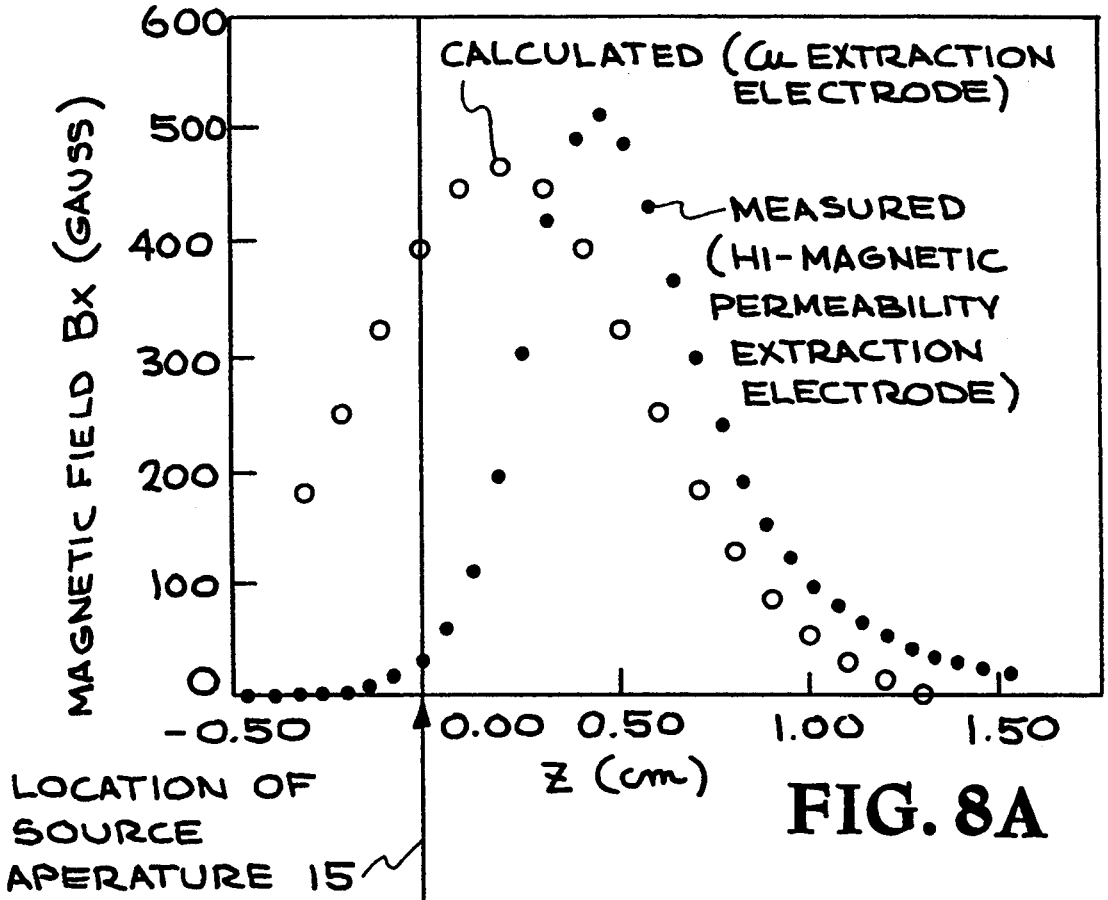
FIG. 8 is a graph plotting the magnetic field strength as a function of distance from a pair of magnets located in the exit aperture electrode, 8A) when the magnets are not located near carbon steel, and 8B) when the magnets are located against an element of carbon steel.
Figure 8B:
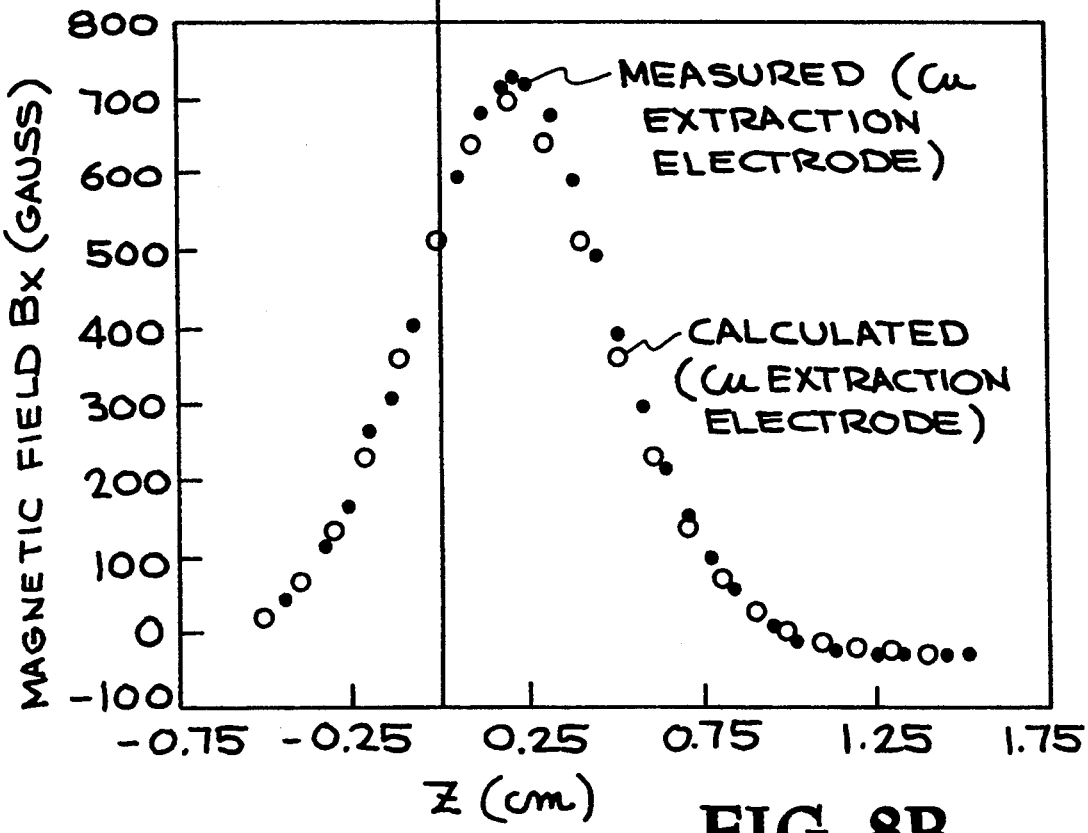

Referring to the drawings, FIG. 1 shows the beam transport system 11 and beam axis 21 from a negative ion source 10, not shown. A metal with high magnetic permeability, such as carbon steel, 12 is incorporated in the ion source housing 16 surrounding the exit aperture 15 for the negative ions. In one embodiment a pair of samarium-cobalt (SmCo) permanent magnets 14, may be located on the beam side, or exit interface, of the exit aperture. FIG. 8 shows that using iron which has a high magnetic permeability, for example carbon steel, in the housing design has the effect of shifting the peak of the magnetic field away from the source even when the magnets are located immediately adjacent to the housing. This greatly reduces penetration of the magnetic field into the source chamber which would otherwise have a destructive effect on the production of the negative ions. Use of carbon steel near the exit aperture enables magnets sufficiently strong to deflect electrons from the exit beam of negative ions (peak magnetic field strength of 550 gauss) can be located within approximately 3 mm of the inside face of the aperture. A major component of the invention is the use of carbon steel, or other material of high magnetic permeability, at or near the exit aperture of the ion source.

Removal of extracted electrons

The extraction electrodes extract negative ions by an electric field. The positively-biased electrodes provide a means, that is, an electric field, for extracting a flow of negative ions from the extraction zone. Negative ions and electrons accelerate towards the extraction electrode with enough energy to exit the ion source volume. An important advantage and novel feature of this invention is a means to remove the extracted electrons from the negative ion beam.

A pair of magnets 14, located in the beam path provide a magnetic field aligned perpendicularly to the electric field used to extract the beam. Copper plugs, 13, located between the magnets and around the exit aperture maintain a homogeneous magnetic field across the exit orifice without perturbing the electric potential because they are electrically conducting and non magnetizable. The magnetic field exerts a force on the charged particles that is perpendicular to both the velocity of the charged particle and the direction of the magnetic field of induction, $F=q(v \times B)$, where F is the force vector, q is the charge of the particle, v is the velocity vector, and B is the magnetic field of induction vector. This causes the charged particles to curve in a direction perpendicular to both v and B. The radius of curvature is governed by, $R=mv/Bq$, where m is the mass of the particle, v is the velocity of the particle, B is the magnetic field of induction, and q is the charge of the particle. Since the mass of an electron is considerably smaller than the mass of an ion, the radius of curvature of the electron path is smaller (or tighter) than for an ion and by using an optimal magnetic field strength, the electrons can be diverted from the ion beam with only minor deflection of negative ions from the beam path. This small ion deflection is corrected by suitable tuning of the focusing electrodes. For an accelerator like the Supercollider Superconductor (SSC), where the ion current is approximately 30 milliAmps, the range of optimal magnetic field strengths that can be used is approximately 250 gauss to approximately 1000 gauss. At lower magnetic field strengths the electrons will not be usefully deflected from the ion beam path. There is no theoretical upper limit to the magnetic field strength that can be used, but practically speaking the amount of high magnetic moment material, such as carbon steel, that must be used to shield the ion source will become prohibitive with increasing magnetic field strengths. Another disadvantage that will manifest with increasing magnetic field is that the negative ion beam optics will deteriorate. Another disadvantage that will manifest with increasing magnetic field strength is that the ions will be increasingly diverted from the ion beam path. This can be compensated by changing the placement, geometry, and electric potential of the electron collecting electrode and ion beam focusing electrode but will become undesirably cumbersome at higher magnetic field strengths.

The relationship between negative ion beam current, magnetic field strength, volume of carbon steel, electrode geometry, and electrode potential is given by a set of complex equations modeled by computer code. These codes, are briefly described and referred to in a paper authored by the inventors, and incorporated herein by reference, (Low-energy injector design for SSC, by O. A. Anderson, C. F. Chan, K. N. Leung, L. Soroka, and R. P. Wells, submitted to the 4th International Conference on ion sources, Bensheim, Germany, *Rev. Sc. Instrum.*, V. 63, p. 2738, 1992). Copy of the code is available from the inventors.

Figure 5:
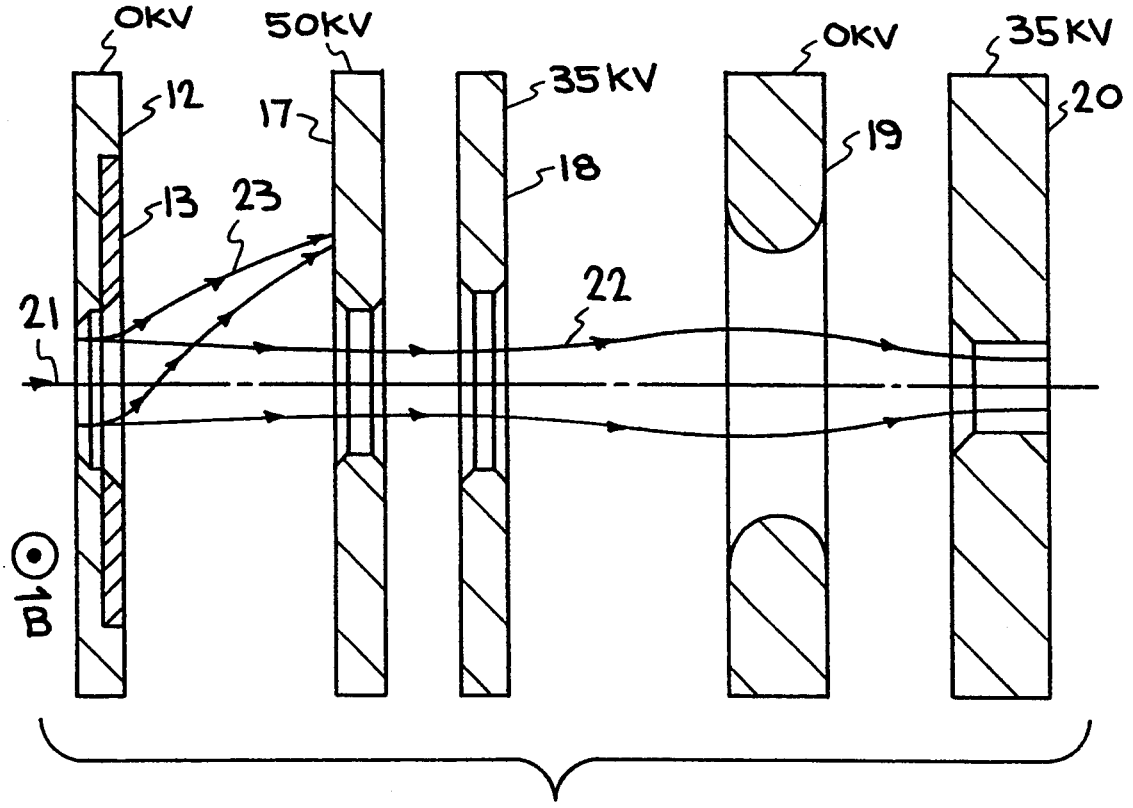
FIG. 5 is a top view in plane B of FIG. 3 or 4 showing the effect on extracted electrons of a pair of magnets located inside the exit aperture electrode. Magnetic field lines would point perpendicularly up form the page.

FIG. 5 shows the electrons being deflected by a pair of magnets 14. The electrons are collected by electrode 17 and the ions are deflected only slightly. FIG. 5 is a based on a planar computer calculation. In this embodiment, electrode 17 is used both as a focusing electrode held at 50 kV with respect to the electrode 12 and as an electron dump for the extracted electrons.

The electron collector is made of conducting material, preferably copper and most preferably oxygen-free copper. Some other materials that might be used include graphite or molybdenum. Graphite has the disadvantage of forming methane during operation of the beam transport system which introduces impurities. Molybdenum is very difficult to machine. Copper has the additional advantage of conducting heat formed as the electrons are collected The surface of the electrode is preferably porous. A porous surface maximizes surface area and limits contamination of the ion beam with secondary electrons by mechanically trapping them inside the collector. Secondary electrons are also prevented from entering the beam downstream by the reverse electric potential applied to the third electrode. The reverse electric potential on the third electrode (18 or 19), nominally 35 kV and 0 kV, respectively, with respect to the first electrode 12, reduces the beam energy to allow the beam to expand to the correct diameter for beam focusing. It also assists in the electron trapping by confining secondary electrons from electrode 17.

Electrode configuration and beam focusing in the beam transport system

The electrodes used to extract the negative ion beam from the ion source, collect the electrons diverted from the beam, and focus the beam for the next stage are constructed in a with attention to electrode material, shape, position in the beam line, and the potential the electrode will be held at.

Electrode material is preferably of oxygen-free copper so that hydrogen ions will not combine to form water. However the electrodes may be made of any conductor, including any copper, molybdenum, or graphite.

Figure 2:
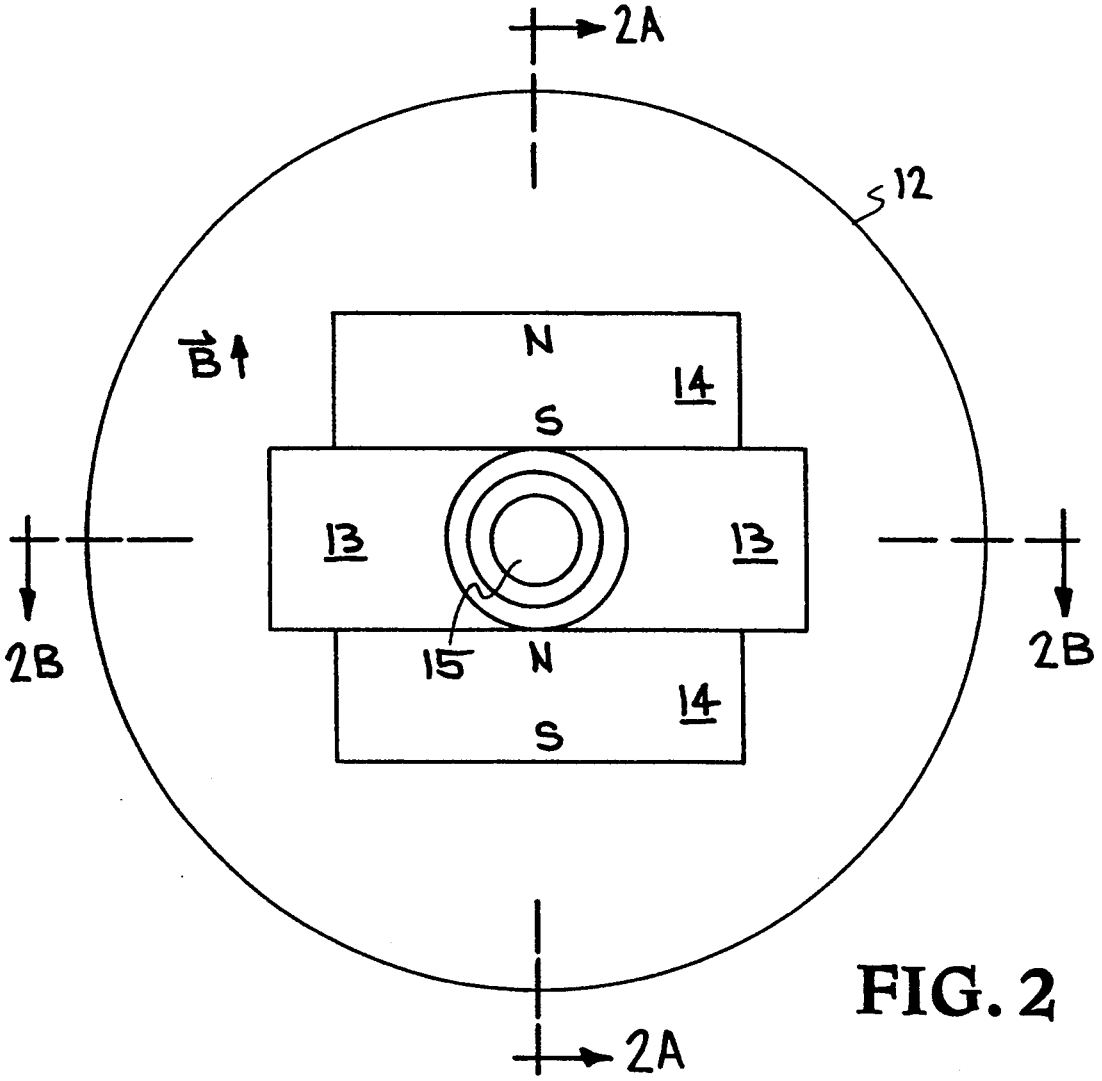
FIG. 2 is a top view of the exit aperture showing one possible configuration of carbon steel, copper inserts, and permanent magnets.

A four electrode beam transport system is shown to the fight of the ion source in FIG. 1. This configuration for a beam transport system is shown in greater detail in FIG. 3. The first electrode, shown in FIG. 2, is mounted together with magnets in a carbon steel manifold attached to the housing of the ion source. The carbon steel manifold has a hole in the center 15 to form beam the exit, or extraction, aperture. The potential of the first electrode, which is used to extract ions and electrons form the ion source, is maintained at zero potential relative to the other electrodes in the beam transport system. One factor that limits the strength of the magnets used to divert electrons from the negative ion beam path is that as the magnetic field strength increases, effects on the negative ions increase until eventually it is not possible to focus the negative ion beam 22. Another limiting factor to the magnitude of the magnetic field used is that the angle of the diversion will be increased so sharply that the geometry of the placement of the electron collection electrode will be less advantageous. Yet another limiting factor on the strength of the magnetic field is that the thickness required for the high-magnetic-permeability housing used to channel magnetic field lines and thereby shield the exit aperture and ion source from the magnetic field becomes disadvantageously large. In general, one wants the magnets to have the minimum thickness to be able to defect the electrons, yet perturb the negative ion be, am as little as possible. Experimenting with trade offs of advantages and disadvantages involving the magnitude of the magnetic field to be used will be obvious to one skilled in the an as s/he uses this invention. Magnets that produced a magnetic field between about 400 and about 650 gauss were used in most cases. Occasionally magnets that produced a magnetic field between about 350 and about 750 gauss were used and it is possible to use magnets that produce a magnetic field between about 300 and about 1000 gauss.

Figure 3A:
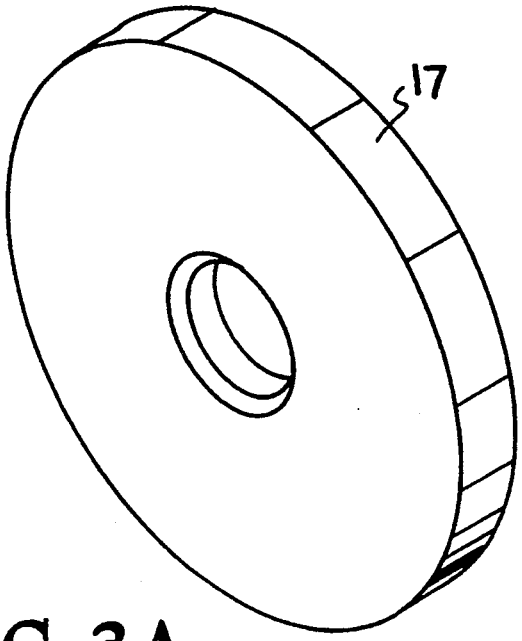
FIG. 3A is a 3-dimensional view of ring electrode, 17.
Figure 3:
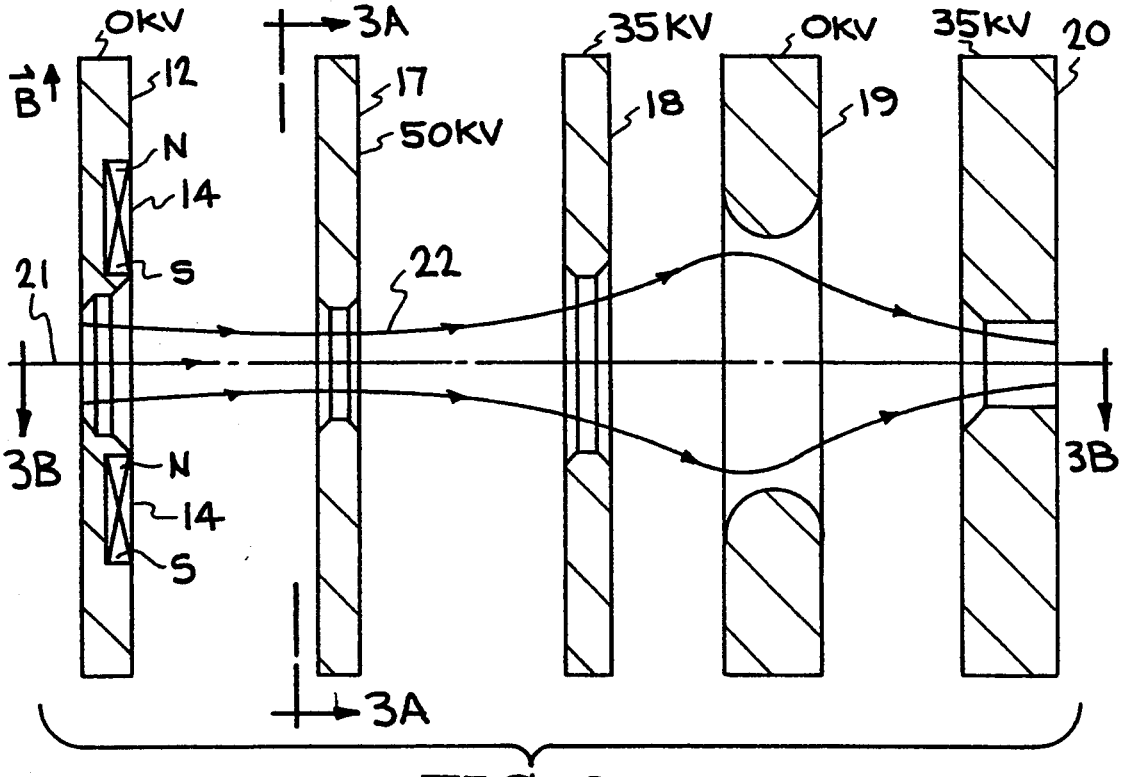
FIG. 3 is a side view in plane A of the ion transport system showing the permanent magnets located in the exit aperture electrode. The series of lines between the electrodes show contours of equal electric potential.
Figure 3B:
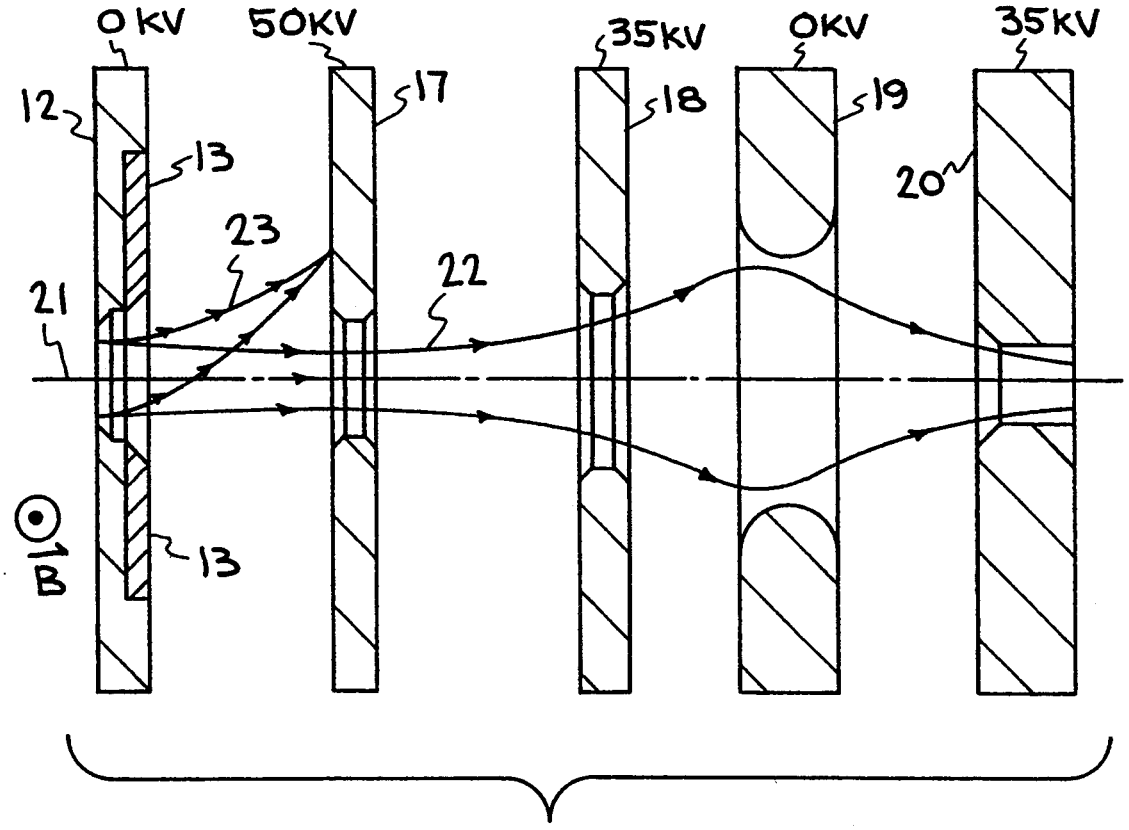
FIG. 3B is a side view in plane B of the ion transport apparatus showing the copper inserts located in the exit electrode.

The remaining electrodes in the beam transport system are ring electrodes, illustrated in the 3-dimensional view of electrode 17, FIG. 3A. They extend varying amounts into the beam path and are placed at varying distances from each other. The exact dimensions and potential of the electrodes are calculated using known laws of physics and electronics, and depend on a variety of parameters of the system, including the ion current, emittance and shape at the ion source exit aperture and the entry requirements of the next acceleration stage. The second electrode accelerates the beam to 50 keV and collects deflected electrons. In FIG. 3, the magnetic field points to the top of the page and is approximately less than 40 gauss at the inside interface of the exit aperture and approximately 540 gauss at 0.5 cm from exit interface of the exit aperture. The ratio of electrons to negative ions at the exit interface of the exit aperture is approximately 19:1. There are essentially no extracted electrons remaining in the beam beyond the second electrode. The deflection of electrons 23 to the second electrode, 17, is illustrated in FIG. 3*b*. In FIG. 3*b* the magnetic field vector, B, points into the page.

The third electrode, 18, slowly reduces the beam energy to the nominal value of 35 keV while allowing the beam to expand to the correct diameter for focusing at the last ring-lens electrode, 19, sometimes referred to in the literature as a "ring-lens LEBT" (O. A. Anderson, et at., Proceedings of 2nd European Particle Accelerator Conference, Nice, 1990; Ed. Frontieres, Gif-sur-Yvette, 1990, p. 1288) incorporated herein by reference. The series of lines shown between electrodes in FIG. 3 are lines of equal electric potential; the lines running left to right represent the trajectory of negative ions in the beam path. Both were calculated for the particular electrode placements, sizes and applied voltages, based on a $H^-$ current at the exit aperture of 30 mA and using computer code based on standard principles of physics and electronics.

Figure 4:
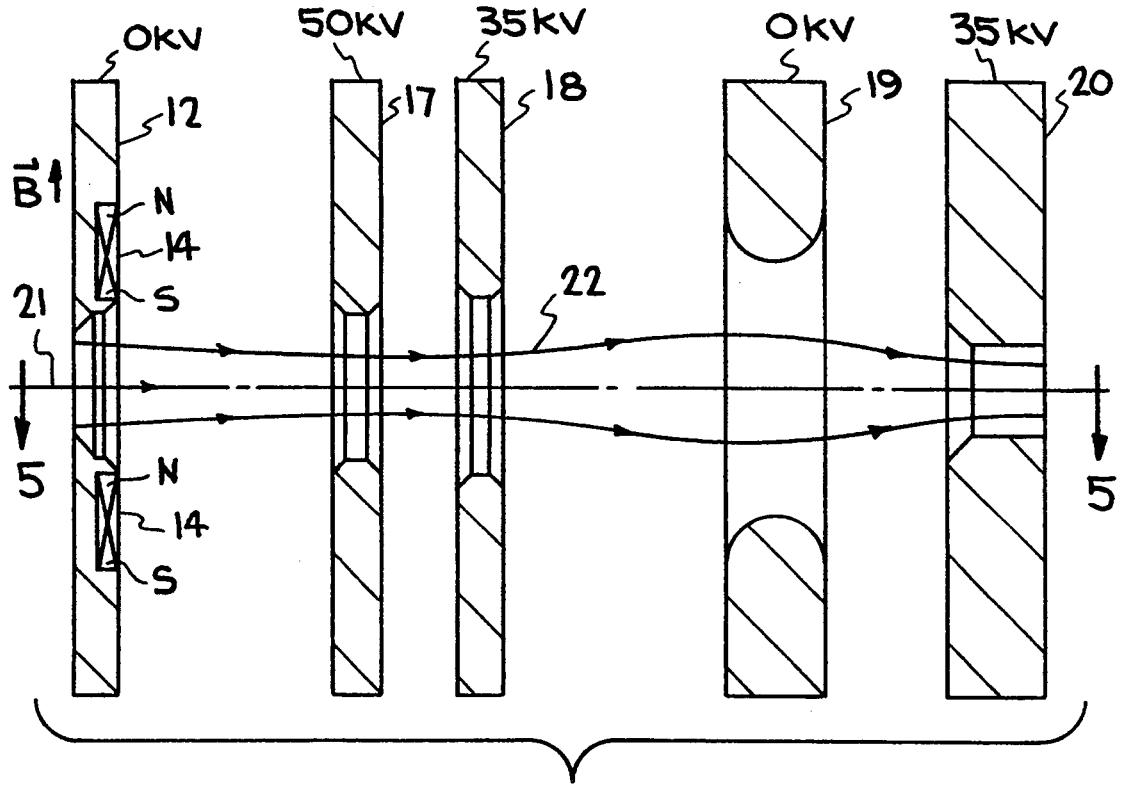
FIG. 4 is a side view in plane A of the ion transport system showing how changing the position of the third electrode affects the ion-beam entry-angle.

The last electrode, 19, is held at an electrical potential resulting in a strong deceleration stage. In FIGS. 1, 3 and 4, the ring lens, 19, is held at 0 keV. The ring lens is a rounded electrode designed for minimum aberration. Its roundness distinguishes it from an aperture lens, while its shortness distinguishes it from an einzel lens.

With minimal trial and error, one can modify the dependent variables of electrode dimension, placement, or applied voltage and maintain beam focus. Alternately, small changes in these parameters will allow one skilled in this art to change certain parameters of beam focusing as necessary. FIG. 4 for example shows electrode 18 placed closer to electrode 17 than in FIG. 3. For otherwise identical conditions, this change in placement results in a less steep angle of entry into the next accelerator stage, 20. FIG. 5 shows a top view of the beam path, with the magnetic field vector pointing down into the page and the electrons being diverted out of the beam path for collection on the second electrode.

Figure 6:
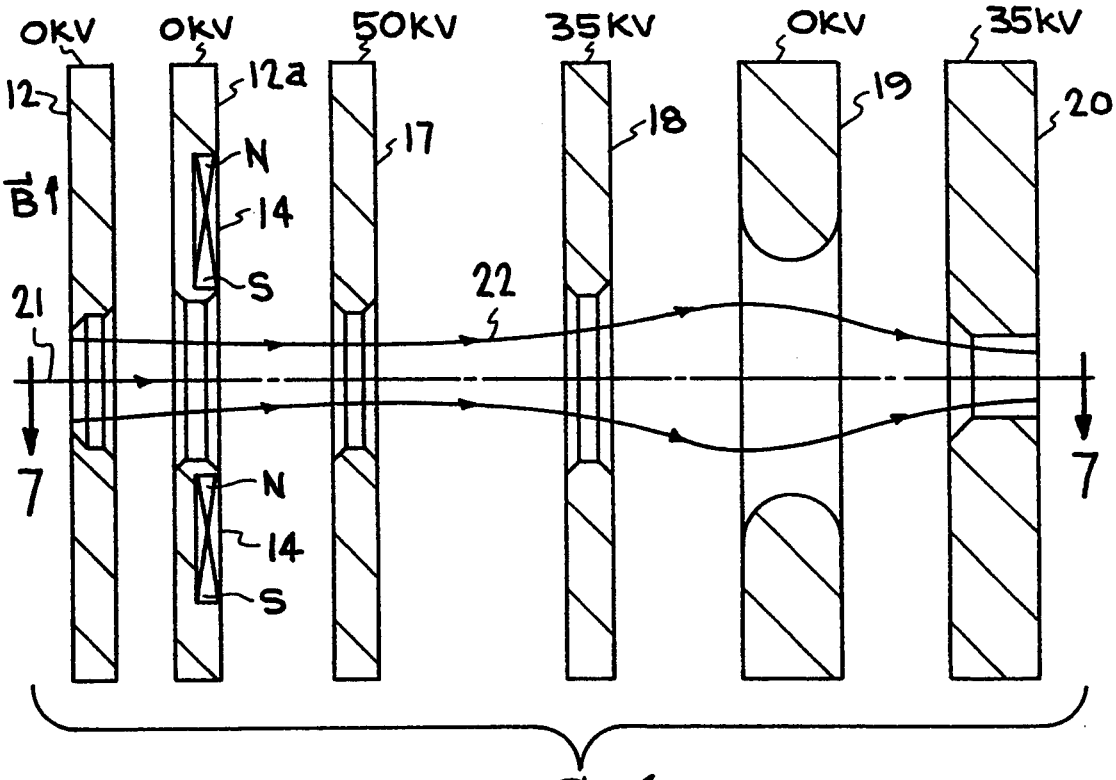
FIG. 6 is a side view diagram in the plane of A of the injection system using a pair of magnets located in the second electrode of the beam transport system.
Figure 7:
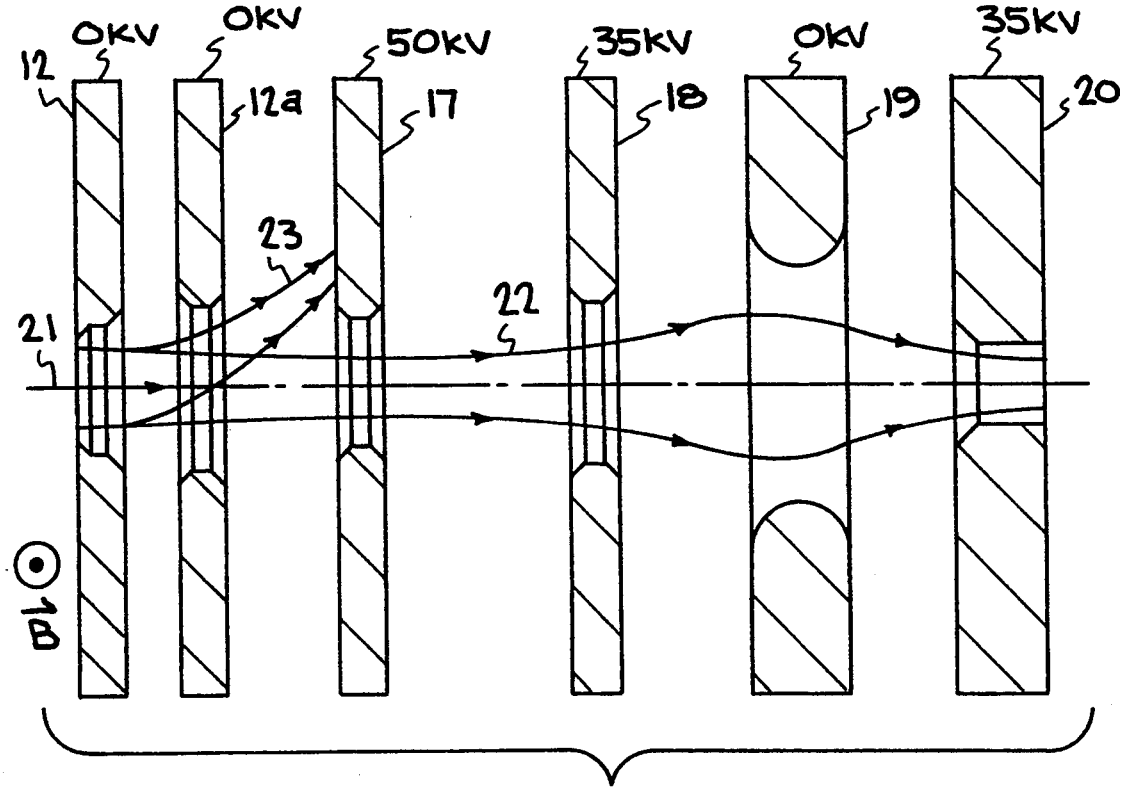
FIG. 7 is a top view in the plane of B of FIG. 6, showing the effect on extracted electrons of a pair of magnets located inside the second electrode of the beam transport system.

FIG. 6 shows an electrode configuration wherein the magnets used to created a magnetic field to divert electrons are placed downstream of the exit aperture. This placement obviates the need for a carbon steel manifold to place the magnets in, but has the disadvantage of lengthening the beam transport system and creating a field on the downstream side that will divert electrons prematurely. This configuration also requires an extra power supply with a voltage follower and complex feedback circuit to maintain the voltage bias on the extra electrode. FIG. 7 is a top view of the configuration shown in FIG. 6. In FIG. 7, the magnetic field vector, B, is pointing down, perpendicular to the plane of the page.

Figure 9:
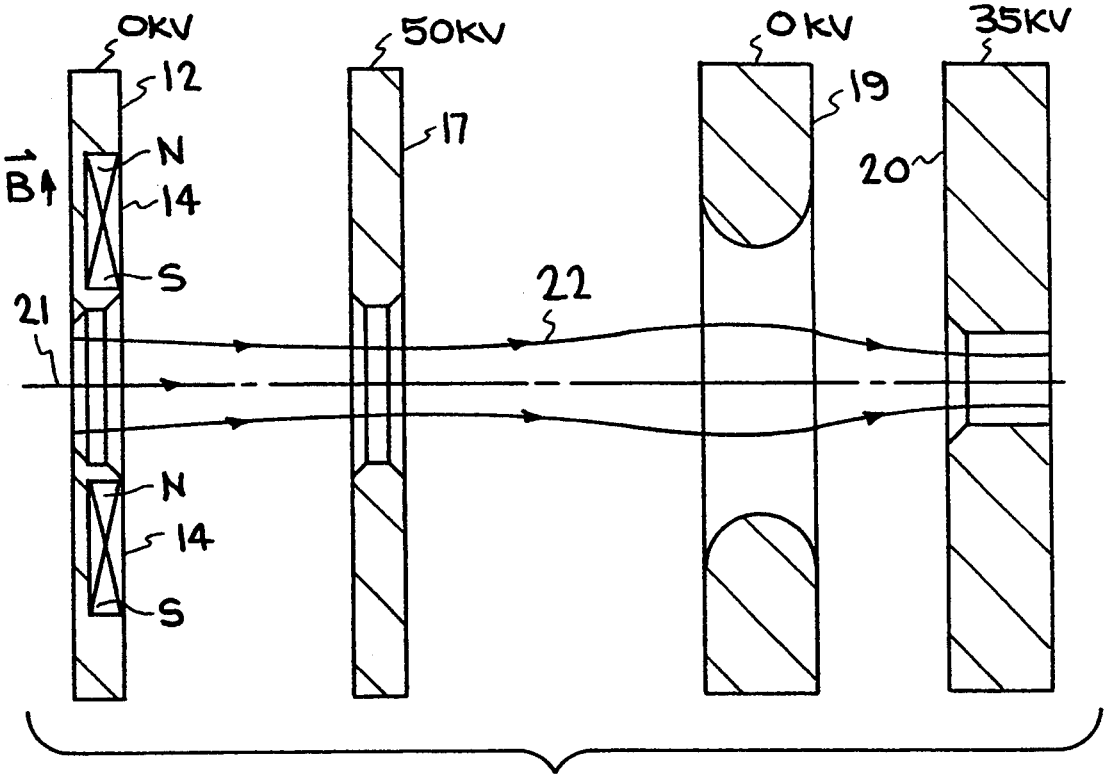
FIG. 9 is a diagram showing an embodiment that uses only 3 electrodes.
Figure 10:
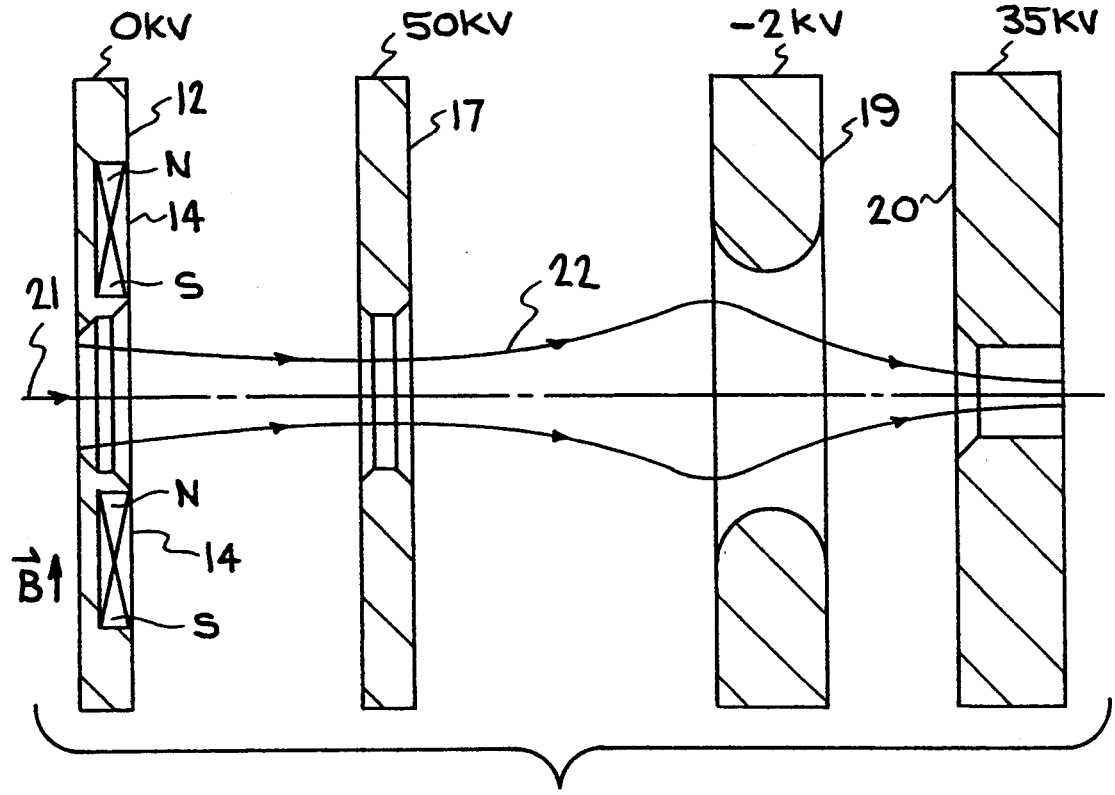
FIG. 10 is a diagram showing how changing the bias on the LEBT electrode changes the angle of convergence of the ion beam.

A further improvement in the electrode configuration, for some applications, is illustrated in FIGS. 9 and 10. For a required ion current and emittance at the source aperture and a required angle of convergence at the entrance to the next stage, ring electrodes and potentials can be chosen that allow the beam to be focused and electrons to be diverted, using only three electrodes. The simplicity of this design is beneficial for several reasons. The open design facilitates the pumping required to maintain a clean environment around the beam. Fewer electrodes require fewer power supplies and simpler electronics. It is easier to maintain a constant voltage at each electrode. Further, the beam focus can be changed if, for example, a deeper convergent angle of the beam at exit to the next stage is desired. The change in convergent angle can be modified by simply changing the bias of the third electrode by a few kV, as illustrated in FIG. 10. Changing the potential of the third electrode from 0 kV with respect to the extraction electrode to −2 kV increases the angle of convergence of the beam as it exits the beam transport system to the next stage. Another way to tone the beam so that the angle of convergence increases would be to replace the third electrode with a new one that has a smaller aperture radius.

DESCRIPTION OF PREFERRED EMBODIMENT

EXAMPLE 1

FIG. 2 shows a possible configuration of the extraction electrode, constructed from carbon steel, copper inserts and SmCo permanent magnets embedded within it. In the preferred embodiment, they are located on the exit interface, with the ion exit aperture, through which negative ions are extracted from the ion source, located in the carbon steel extraction electrode. This configuration has the highly desirable feature of incorporating the extraction electrode, the magnets that provide the magnetic field necessary to deflect electrons from the beam (deflection field) and the carbon steel that shields the ion source volume from the negative effects of the deflection field, into a single element.

Figure 2A:
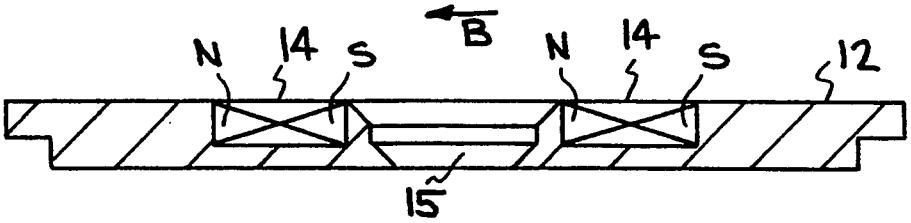
FIG. 2A is a side view in plane of A of the exit aperture shown in FIG. 2.
Figure 2B:
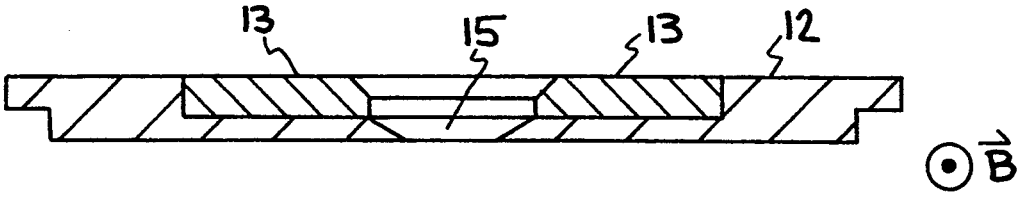
FIG. 2B is a side view in plane B of the exit aperture shown in FIG. 2.

In our preferred embodiment, the carbon steel is used to form the ion source housing in which the exit aperture is made. The exterior geometry may be made in any shape but is conveniently made in the shape of a circle with a diameter of at least approximately 40 mm. Two conducting plugs, typically made of oxygen-free copper, are located symmetrically, on diametrically opposed sides of the exit aperture, and between the magnets, in a plane parallel to the housing. Permanent magnets are also located symmetrically, on diametrically opposed sides of the exit aperture, in a line orthogonal to the line of the plugs. The function of the plugs is to maintain a homogeneous magnetic field across the exit interface of the exit aperture, while allowing the magnetic field lines to be channeled through the carbon steel behind the plugs. It is necessary for the magnetic field not to be disturbed in the plane of the magnets, so in that plane, the carbon steel is replaced with copper inserts, 13 or plugs. The copper is preferably oxygen free so that in the case of a hydrogen ion beam, the combination of hydrogen with oxygen to form water is minimized. For maximum advantage, both the plugs and the magnets are located approximately 1 mm away from the aperture edge so as to leave a ring of carbon steel around the aperture exposed to the exit interface of the housing. In our embodiment, shown in FIG. 2, a 3.2 mm ring of carbon steel 17 is left exposed. FIGS. 2A and 2B show crossections of the aperture structure built with 2 mm by 6 mm by 20 mm permanent magnets and similarly sized copper plugs. The volume of magnetic material required to produce the necessary field may vary from about 100 $mm^3$ to approximately 1000 $mm^3$. The optimum volume can be easily found by varying for a given application by one skilled in the art. The diameter of the aperture in this embodiment is 5.6 mm, but can range from 3 mm to 12 mm. The outside lip 18 provides a means to connect to the carbon steel extraction electrode to the ion source housing. Once again, performance trade-offs involved in changing these parameters will be obvious to one skilled in the art. If the diameter of the exit aperture is decreased without changing other parameters of the system (such as, for example, the power of the ion source) the beam current will decrease. Depending on the application, a beam of a particular magnitude will be necessary. If the diameter of the exit aperture is increased, other parameters will vary.

EXAMPLE 2

FIG. 5 is a top view of the electrons and negative ions in the beam transport injection system. It shows the effect on the extracted electrons and negative ions due to a pair of magnets located inside the first electrode. It illustrates a preferred embodiment of the second electrode, which also serves as an electron-collection and acceleration electrode. It is the next electrode encountered by the negative ions and electrons after they are extracted through the exit aperture by the extraction electrode. The second electrode is preferably made of oxygen-free copper. It is a ring electrode, with an aperture radius of approximately 0.5 cm radius through which the beam passes. It is approximately 0.3 cm thick and is located approximately 1.4 cm downstream from the extracting electrode. This location in the negative ion beam path captures the deflected electrons at an angle that prevents stray electrons from drifting back into the ion beam path. The second electrode is held at 50 kV relative to the extraction electrode. This potential accelerates the negative ions in their beam path. The electric potential also slightly compresses the beam as part of the beam focusing steps. The numerous, roughly parallel lines represent lines of equal electric potential, calculated using normal laws of physics.

EXAMPLE 3

FIG. 9 is a side view of one of the electrode configurations. Because it views the beam transport system from the side rather than from the top as in FIG. 5, the electron deflection is not visible. FIG. 9 shows one embodiment of the beam optics, using only three electrodes. The third electrode is a ring electrode located 1.8 cm downstream from the second electrode. It is 0.7 cm thick and has a open aperture of 0.85 cm radius. The relative electric potential is 0 volts. It's negative potential with respect to the second electrode stops secondary electrons that may have been generated by deflected electrons striking the collector electrode. The relatively negative potential also allows the negative ion beam to expand to a wider diameter. This results in a convergence when the negative ions pass the third electrode and are once again accelerated toward, and are injected into, the next acceleration stage, which typically has a relative positive potential of 35 keV. The relative placement of the electrodes and their potentials in our negative ion beam transport system is determined to accommodate the requirements of a particular accelerator system, the SSC. However, using the normal laws of physics it will be apparent to one skilled in the art that applying a slightly different potential to the third electrode, as illustrated in FIG. 10, will change the angle of convergence at the entry to the next acceleration stage. Similarly, altering the number of electrodes, as shown in FIG. 3, or changing the potential on the electrodes, can further tune the parameters of the transport system to whatever beam current, emittance, convergence or other parameter requires changing.

We claim:

1. A negative ion beam injection apparatus, comprising:

a. a negative ion generating means with an exit aperture of sufficient diameter to allow negative particles to exit the ion generating means, b. a negatively-charged particle extracting means, c. an electron removal means located exterior to the ion generating means, d. a magnetic field shielding means, and e. a beam transport means.

2. The negative ion beam injection apparatus of claim 1, wherein the negative ion generating means generates hydrogen ions.

3. The negative ion beam injection apparatus of claim 1, wherein the negative ion generating means comprises a filament.

4. The negative ion beam injection apparatus of claim 1, wherein the negative ion generating means comprises a radio frequency antenna.

5. The apparatus of claim 4, wherein the radio frequency antenna is glass coated.

6. The apparatus of claim 4, wherein the radio frequency antenna is ceramic coated.

7. The negative ion beam injection apparatus of claim 1, wherein the negatively-charged particle extracting means comprises an extracting electrode having an electric potential that is positive with respect to the ion generating volume.

8. The apparatus of claim 7 wherein the extracting electrode comprises a copper electrode.

9. The apparatus of claim 7 wherein the extracting electrode comprises an oxygen-free copper electrode.

10. The apparatus of claim 1, wherein the exit aperture includes the magnetic-field shielding means comprising material of magnetic permeability greater than 100 gauss/oersted.

11. The apparatus of claim 1 wherein the magnetic-field shielding means comprises a material of magnetic permeability between about $10^2$ and $10^7$ gauss/oersted.

12. The apparatus of claim 11 wherein the magnetic-field shielding means comprises a material of magnetic permeability between about $10^3$ and $10^6$ gauss/oersted.

13. The apparatus of claim 12 wherein the magnetic-field shielding means comprises a material of magnetic permeability between about $10^3$ and $10^5$ gauss/oersted.

14. The apparatus of claim 13 wherein the magnetic-field shielding means comprises a material of magnetic permeability between about $10^3$ and $10^4$ gauss/oersted.

15. The apparatus of claim 1 wherein the magnetic-field shielding means comprises a material of carbon steel composition.

16. The apparatus of claim 15 wherein the magnetic-field shielding means comprises a material of carbon steel composition, designated by any SAE Number from 1006 to 1095, inclusively.

17. The apparatus of claim 1 wherein the magnetic-field shielding means comprises a machinable material of magnetic permeability greater than 100 gauss/oersted.

18. The negative ion beam injection apparatus of claim 1, wherein the electron removal means comprises:

a. a magnet so aligned that a component of the field of induction is perpendicular to the electric field of the beam path, b. the magnetic field shielding means comprising shielding material of magnetic permeability greater than 100 gauss/oersted, and c. an electron collecting electrode.

19. The apparatus of claim 18, wherein the magnet is a permanent magnet.

20. The apparatus of claim 19, wherein the magnet is a SmCo permanent magnet.

21. The apparatus of claim 18, wherein the magnet is an electromagnet.

22. The apparatus of claim 18, wherein the magnet produces a magnetic field between 300 and 1000 gauss.

23. The apparatus of claim 22, wherein the magnet produces a magnetic field between 350 and 750 gauss.

24. The apparatus of claim 23, wherein the magnet produces a magnetic field between 400 and 600 gauss.

25. The negative ion beam injection apparatus of claim 1, wherein the beam transport means comprises:

a. an extractor electrode, b. the magnetic-field shielding means comprising shielding material of magnetic permeability greater than 100 gauss/oersted, c. magnets exterior to the negative ion generating means and downstream from the shielding means, d. an acceleration and electron collecting electrode, and e. a focusing electrode.

26. The negative ion beam injection apparatus of claim 1, wherein the beam transport means comprises:

a. an extractor electrode, b. a magnet containing electrode at the same electric potential as the extractor electrode, c. an acceleration and electron collecting electrode, and d. a focusing electrode.

27. The negative ion beam injection apparatus of claim 25 wherein the beam transport means additionally comprises a deceleration electrode.

28. The negative ion beam injection apparatus of claim 26 wherein the beam transport means additionally comprises a deceleration electrode.

29. The apparatus of claim 16 wherein the magnetic-field shielding means comprises a material of carbon steel composition designated by SAE Number 1018.

30. The apparatus of claim 18 wherein the magnetic field shielding means is used as an extraction electrode.

31. The apparatus of claim 18, wherein the electron collecting electrode is a focusing electrode.

32. The apparatus of claim 10 wherein the exit aperture includes the magnetic field shielding means and electron deflecting magnets.

33. The apparatus of claim 32 wherein the exit aperture additionally comprises electrically-conducting, nonmagnetic metal inserts placed between the magnets and around exit the aperture opening.

34. The apparatus of claim 33 wherein the metal inserts comprise copper or oxygen-free copper.

35. The apparatus of claim 1 wherein the exit aperture is comprised of the magnetic-field shielding means.

36. The apparatus of claim 1 wherein the exit aperture comprises an extraction electrode.

37. The apparatus of claim 27, wherein the acceleration, electron collecting, and deceleration electrodes are made of one of copper, oxygen-free copper, molybdenum, graphite, and alloys thereof.

38. The apparatus of claim 28, wherein the acceleration, electron collecting, and deceleration electrodes are made of one of copper, oxygen-free copper, molybdenum, graphite, and alloys thereof.

39. A method of removing electrons from a negative ion beam produced in an ion beam injection apparatus comprising:

a. extracting negatively charged particles from an ion source through an exit aperture of sufficient diameter to allow negative particles to exit the ion source volume by use of an extraction electrode having an electric potential that is positive with respect to the ion generating volume;
b. diverting electrons immediately after they traverse the exit aperture with magnets located adjacent to the exit aperture,
c. shielding the ion source volume from the magnetic field of said magnets by surrounding the exit aperture with high magnetic permeability material and
d. collecting the diverted electrons on a second electrode in the ion beam path.

40. A producing a negative ion beam comprising:

a. extracting ions from a plasma ion source by a positive extraction electrode,
b. removing electrons from the extracted beam using a magnetic field perpendicular to the beam path,
c. shielding the plasma ion source from the magnetic field with a magnetic-field shield
d. controlling the trajectory of the beam by the electrostatic potential of circular focusing electrodes located along the beam path, and
e. imparting energy to the beam by electrodes so that the beam energy meets the injection requirements of a next stage of the ion accelerator.

* * * * *